US009757965B1

(12) United States Patent
Uehling

(10) Patent No.: US 9,757,965 B1
(45) Date of Patent: Sep. 12, 2017

(54) PRINTING DEVICE PERFORMANCE ANALYSIS

(71) Applicant: Hewlett-Packard Development Company, L.P., Houston, TX (US)

(72) Inventor: Devin Scott Uehling, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/294,385

(22) Filed: Oct. 14, 2016

(51) Int. Cl.

| | |
|---|---|
| ***B41J 13/00*** | (2006.01) |
| ***B41J 29/393*** | (2006.01) |
| ***B41J 13/10*** | (2006.01) |
| *B65H 1/00* | (2006.01) |
| *B65H 3/06* | (2006.01) |

(52) U.S. Cl.
CPC ..... *B41J 13/0009* (2013.01); *B41J 13/0018* (2013.01); *B41J 13/103* (2013.01); *B41J 29/393* (2013.01); *B65H 1/00* (2013.01); *B65H 3/06* (2013.01); *B65H 2220/01* (2013.01); *B65H 2220/02* (2013.01)

(58) Field of Classification Search
CPC .. B41J 13/0009; B41J 29/393; B41J 13/0018; B41J 13/103; B65H 1/00; B65H 3/06; B65H 2220/01; B65H 2220/02; B65H 2220/03; B65H 2220/11
See application file for complete search history.

(56) References Cited

U.S. PATENT DOCUMENTS

| | | | | |
|---|---|---|---|---|
| 5,785,224 | A * | 7/1998 | Nowakowski | B65H 35/10 225/100 |
| 6,869,070 | B2 | 3/2005 | Shimamura et al. | |
| 8,979,088 | B2 | 3/2015 | Itabashi | |
| 9,139,387 | B2 | 9/2015 | Inoue | |
| 2004/0245698 | A1* | 12/2004 | Naruoka | B65H 3/0653 271/10.11 |
| 2006/0151936 | A1* | 7/2006 | Brown | B65H 1/08 271/10.01 |
| 2008/0272535 | A1* | 11/2008 | Gustafsson | B65H 1/025 271/22 |
| 2015/0132039 | A1 | 5/2015 | Tobinaga et al. | |
| 2015/0344246 | A1 | 12/2015 | Zensai | |
| 2015/0360892 | A1 | 12/2015 | Yoshimizu | |

* cited by examiner

*Primary Examiner* — Henok Legesse
(74) *Attorney, Agent, or Firm* — Mannava & Kang P.C.

(57) ABSTRACT

In some examples, printing device performance analysis may include actuating a motor to operate a first separation tire of a printing device in a first rotary direction. The first separation tire may be operable adjacent to a second separation tire rotatable in a second rotary direction that is opposite to the first rotary direction to separate physical media. Printing device performance analysis may further include actuating the motor to operate the first separation tire in the second rotary direction, and determining whether a motor torque difference of the motor between the first and second rotary directions is greater than a predetermined threshold.

15 Claims, 6 Drawing Sheets

PRINTING DEVICE PERFORMANCE ANALYSIS

BACKGROUND

A printing device, such as a printer, multifunction printer, and/or other such devices may be described as a peripheral which is used to make a persistent human readable representation of graphics or text on physical media such as paper. A printing device may include various components to move the physical media from a first location, such as an input tray, to a second location, such as an output tray.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
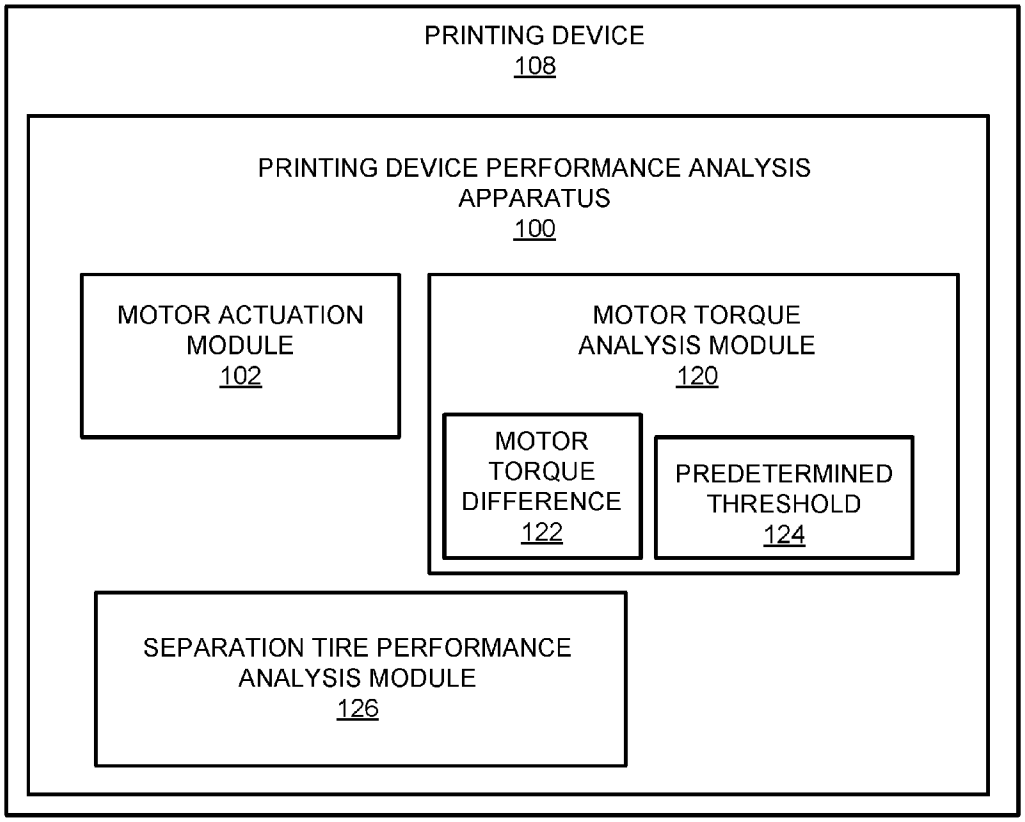
FIG. 1 illustrates a layout of a printing device performance analysis apparatus, according to an example of the present disclosure.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

A printing device performance analysis apparatus, a method for printing device performance analysis, and a non-transitory computer readable medium having stored thereon machine readable instructions to provide printing device performance analysis are disclosed herein. The apparatus, method, and non-transitory computer readable medium disclosed herein provide feedback as to whether separation tires for a printing device operate correctly or incorrectly (e.g., due to improper installation).

With respect to separation tires, a printing device may include two or more separation tires to separate physical media (e.g., paper) into single physical medium (e.g., single sheets of paper) as the physical media is fed into the printing device. For example, a printing device may include a first (e.g., an upper) separation tire to drive a physical medium into a physical media path (e.g., a paper path), and a second (e.g., a lower) separation tire to provide resistance to stop multiple physical media from being fed into the printing device.

The separation tires may be replaced, for example, during performance of printing device maintenance. For example, the separation tires may be removed and re-installed by "snapping" each of the separation tires onto complementary installation receivers. The separation tires may become dislodged, and thus operate incorrectly, if they are not installed properly. Incorrectly installed separation tires may fail to separate the physical media (e.g., resulting in a high rate of multi-picks). These aspects may result in performance degradation of the printing device.

In order to address the aforementioned technical challenges with respect to the operation of separation tires, the apparatus, method, and non-transitory computer readable medium disclosed herein provide for verification of the proper operation, and thus the proper installation, of separation tires by comparing a motor torque (i.e., a drive train torque) for a motor that operates the separation tires in forward and reverse directions. If a motor torque difference does not exceed a predetermined threshold, the separation tires may be determined to operate incorrectly (e.g., due to improper installation). Accordingly, if one or both of the separation tires are improperly installed or otherwise become dislodged, the apparatus, method, and non-transitory computer readable medium disclosed herein may provide an indication to properly install the separation tires. According to an example, the predetermined threshold may correspond to a torque of a torque limiter associated with the second separation tire that provides resistance to stop multiple physical media from being fed into the printing device.

For the apparatus, method, and non-transitory computer readable medium disclosed herein, modules, as described herein, may be any combination of hardware and programming to implement the functionalities of the respective modules. In some examples described herein, the combinations of hardware and programming may be implemented in a number of different ways. For example, the programming for the modules may be processor executable instructions stored on a non-transitory machine-readable storage medium and the hardware for the modules may include a processing resource to execute those instructions. In these examples, a computing device implementing such modules may include the machine-readable storage medium storing the instructions and the processing resource to execute the instructions, or the machine-readable storage medium may be separately stored and accessible by the computing device and the processing resource. In some examples, some modules may be implemented in circuitry.

Figure 2:
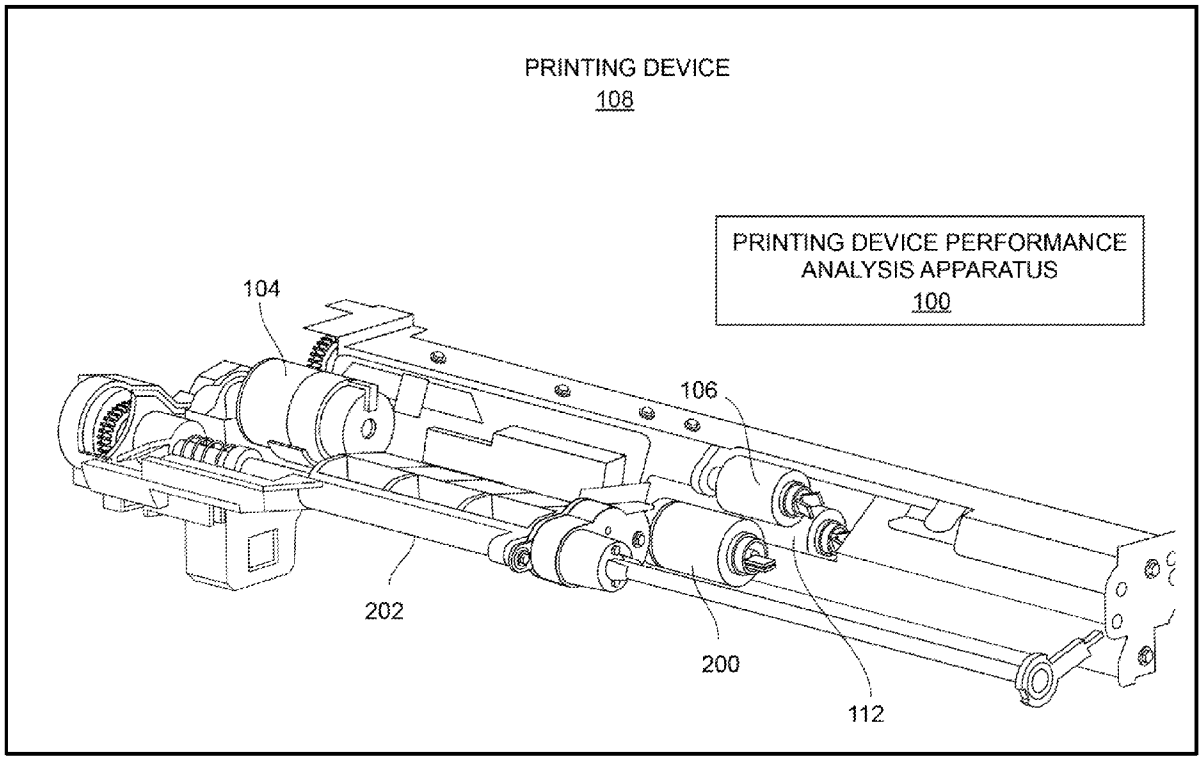
FIG. 2 illustrates an isometric view of certain components of a printing device to illustrate operation of the printing device performance analysis apparatus of FIG. 1, according to an example of the present disclosure.
Figure 3:
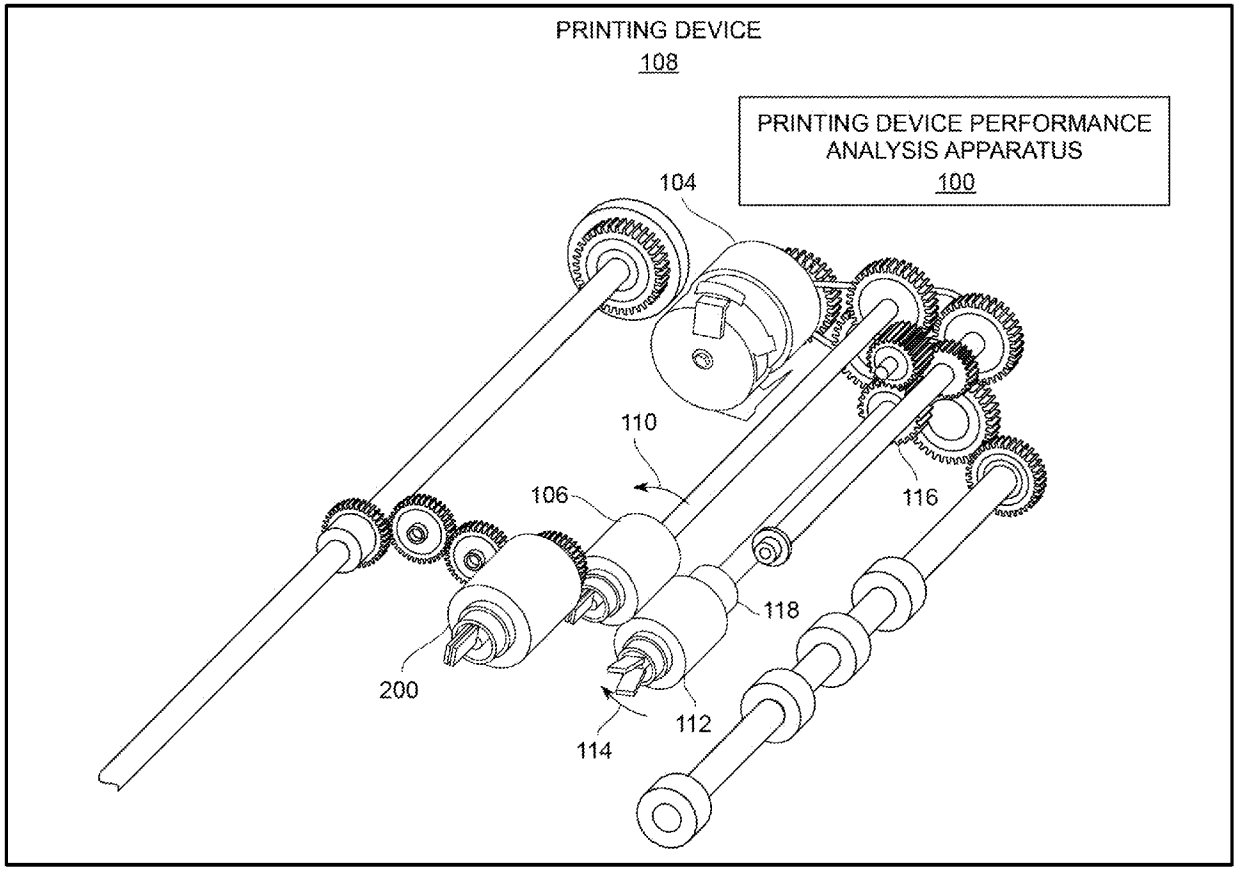
FIG. 3 illustrates an isometric view of certain components of the printing device from a different angle compared to the isometric view of FIG. 2 to illustrate operation of the printing device performance analysis apparatus of FIG. 1, according to an example of the present disclosure.

FIG. 1 illustrates a layout of a printing device performance analysis apparatus (hereinafter also referred to as "apparatus 100"), according to an example of the present disclosure. FIG. 2 illustrates an isometric view of certain components of a printing device to illustrate operation of the apparatus 100, according to an example of the present disclosure. FIG. 3 illustrates an isometric view of certain components of the printing device from a different angle compared to the isometric view of FIG. 2 to illustrate operation of the apparatus 100, according to an example of the present disclosure.

In some examples, the apparatus 100 may include or be provided as a component of a print server for processing print data before the processed print data is transmitted to a printing apparatus, such as an inkjet printer, or any type of printing device. Alternatively, as illustrated in FIGS. 1-3, the apparatus 100 may be a component of a printing device.

Referring to FIGS. 1-3, the apparatus 100 may include a motor actuation module 102 to actuate a motor 104 (see FIGS. 2 and 3) to operate a first separation tire 106 (see FIGS. 2 and 3) of a printing device 108 in a first rotary direction 110 (see FIG. 3). For the example of FIGS. 1-3, the first rotary direction 110 may represent a counter-clockwise rotation direction in the orientation of FIGS. 1-3. The motor 104 may provide power for pick and separation systems of the printing device 108.

The first separation tire 106 may be operable adjacent to a second separation tire 112 (see FIGS. 2 and 3) rotatable in a second rotary direction 114 (see FIG. 3) that is opposite to the first rotary direction 110 to separate physical media. For the example of FIGS. 1-3, the second rotary direction 114 may represent a clockwise rotation direction in the orientation of FIGS. 1-3.

According to an example, the first rotary direction 110 may represent a forward direction for forwarding the physical media from a supply tray of the printing device 108 to an output tray of the printing device 108. The first rotary direction 110 may also represent a forward direction of the motor 104. The second rotary direction 114 may represent a reverse direction of the motor 104.

The motor actuation module 102 may actuate the motor 104 to operate the first separation tire 106 in the second rotary direction 114. In this regard, in response to a determination that the motor 104 is actuated to operate the first separation tire 106 in the second rotary direction 114, the motor actuation module 102 may actuate a one-way clutch 116 (see FIG. 3) to disconnect a drive connection of the motor 104 from a torque limiter 118 (see FIG. 3) associated with the second separation tire 112. The torque limiter 118 may be associated with the second separation tire 112 to provide a generally constant torque to the second separation tire 112 when the motor 104 is actuated to operate the first separation tire 106 in the first rotary direction 110. The torque limiter 118 may create a relatively high mechanical torque in the drive train when the motor 104 is operating in the forward direction. For example, the torque limiter 118 may create a mechanical torque of approximately 25 N*mm, above which the second separation tire 112 may slip. The one-way clutch 116 may disconnect the high torque from the drive train when the motor 104 operates in the reverse direction. The one-way clutch 116 may reduce power consumption associated with the motor 104 and allow for physical medium to be reversed into a physical media tray at the end of print jobs.

According to an example, the motor actuation module 102 may actuate the motor 104 to operate the first separation tire 106 in the first rotary direction 110 for a predetermined rotation angle. For example, the predetermined rotation angle may be approximately 720°, which equates to two full revolutions of the first separation tire 106.

According to an example, the motor actuation module 102 may actuate the motor 104 to operate the first separation tire 106 in the second rotary direction 114 for the predetermined rotation angle. For example, the predetermined rotation angle may be approximately 720°, which equates to two full revolutions of the first separation tire 106 in the second rotary direction 114. According to another example, the predetermined rotation angle for the second rotary direction 114 may be different from the predetermined rotation angle for the first rotary direction 110. For example, the predetermined rotation angle for the second rotary direction 114 may be approximately 1080°, which equates to three full revolutions of the first separation tire 106 in the second rotary direction 114.

According to an example, the motor actuation module 102 may actuate the motor 104 to operate the first separation tire 106 in the first rotary direction 110 for a first predetermined rotation angle corresponding to a predetermined length of movement of physical media. For example, the first predetermined rotation angle may correspond to a predetermined length of movement of physical medium of approximately 12 cm.

According to an example, the motor actuation module 102 may actuate the motor 104 to operate the first separation tire 106 in the second rotary direction 114 for a second predetermined rotation angle corresponding to the predetermined length of movement of the physical media. For example, the second predetermined rotation angle may correspond to the predetermined length of movement of physical medium of approximately 12 cm. According to another example, the second predetermined rotation angle may correspond to a different predetermined length of movement of physical medium (e.g., 10 cm, 14 cm, etc.).

A motor torque analysis module 120 may determine whether a motor torque difference 122 of the motor 104 between the first and second rotary directions 110 and 114, respectively, is greater than a predetermined threshold 124. According to an example, the predetermined threshold 124 may be approximately 19 N*mm, with the torque value of the predetermined threshold 124 being approximately equal to the torque value of the torque limiter 118, and including a margin to prevent false alerts as to whether the separation tires 106 and 112 are correctly or incorrectly installed. Further, the determination as to whether the motor torque difference 122 of the motor 104 between the first and second rotary directions 110 and 114, respectively, is greater than the predetermined threshold 124 may be based on measurement of motor torque during operation of the motor 104 at a generally constant speed.

With respect to the generally constant speed, according to an example, the generally constant speed in the first rotary direction 110 may be approximately 10 cm/second equivalent physical media speed. According to an example, the generally constant speed in the second rotary direction 114 may be the same as the generally constant speed in the first rotary direction 110 (e.g., approximately 10 cm/second equivalent physical media speed). According to an example, the generally constant speed in the second rotary direction 114 may be different from the generally constant speed in the first rotary direction 110.

With respect to the motor torque difference 122 of the motor 104 between the first and second rotary directions 110 and 114, respectively, according to an example, a torque of the motor 104 in the first rotary direction 110 for correctly installed separation tires 106 and 112 may be approximately 70 N*mm. Further, according to an example, a torque of the motor 104 in the second rotary direction 114 for correctly installed separation tires 106 and 112 may be approximately 20 N*mm. Accordingly, the motor torque difference 122 of the motor 104 between the first and second rotary directions 110 and 114, respectively, for the correctly installed separation tires 106 and 112 may be approximately 50 N*mm.

With respect to the motor torque difference 122 of the motor 104 between the first and second rotary directions 110 and 114, respectively, according to an example, a torque of the motor 104 in the first rotary direction 110 for incorrectly installed separation tires 106 and/or 112 may be approximately 20 N*mm. Further, according to an example, a torque of the motor 104 in the second rotary direction 114 for incorrectly installed separation tires 106 and/or 112 may be approximately 20 N*mm. Accordingly, the motor torque difference 122 of the motor 104 between the first and second rotary directions 110 and 114, respectively, for the incorrectly installed separation tires 106 and 112 may be approximately 0 N*mm.

According to an example, in response to a determination that the motor torque difference 122 of the motor 104 between the first and second rotary directions 110 and 114, respectively, is greater than the predetermined threshold 124, a separation tire performance analysis module 126 may determine that the first and second separation tires 106 and 112, respectively, operate correctly. For example, as disclosed herein, according to an example, the predetermined threshold 124 may be approximately 19 N*mm. In this regard, assuming that the motor torque difference 122 of the motor 104 between the first and second rotary directions 110 and 114, respectively, for the correctly installed separation tires 106 and 112 is approximately 50 N*mm, in response to a determination that the motor torque difference 122 of the motor 104 between the first and second rotary directions 110 and 114, respectively, is greater than the predetermined threshold 124, the separation tire performance analysis module 126 may determine that the first and second separation tires 106 and 112, respectively, operate correctly.

According to an example, in response to a determination that the motor torque difference 122 of the motor 104 between the first and second rotary directions 110 and 114, respectively, is less than or equal to the predetermined threshold 124, the separation tire performance analysis module 126 may determine that the first and second separation tires 106 and 112, respectively, operate incorrectly. For example, as disclosed herein, according to an example, the predetermined threshold 124 may be approximately 19 N*mm. In this regard, assuming that the motor torque difference 122 of the motor 104 between the first and second rotary directions 110 and 114, respectively, for the incorrectly installed separation tires 106 and 112 is approximately 0 N*mm, in response to a determination that the motor torque difference 122 of the motor 104 between the first and second rotary directions 110 and 114, respectively, is less than or equal to the predetermined threshold 124, the separation tire performance analysis module 126 may determine that the first and second separation tires 106 and 112, respectively, operate incorrectly. Further, the separation tire performance analysis module 126 may generate an indication to properly install the first and second separation tires 106 and 112, respectively.

According to an example, if either of the two separation tires 106 or 112 is not installed correctly, the torque of the motor 104 will likely be relatively low in both forward and reverse directions of operation of the motor 104.

According to an example, in response to a determination that the motor torque difference 122 of the motor 104 between the first and second rotary directions 110 and 114, respectively, is less than or equal to the predetermined threshold 124, the separation tire performance analysis module 126 may determine that the first and second separation tires 106 and 112, respectively, operate incorrectly. The separation tire performance analysis module 126 may stop further operation of the printing device 108 in association with the operation of the first and second separation tires 106 and 112, respectively. Further, the separation tire performance analysis module 126 may generate an indication to properly install the first and second separation tires 106 and 112, respectively.

According to an example, in response to a determination that the motor torque difference 122 of the motor 104 between the first and second rotary directions 110 and 114, respectively, is less than or equal to the predetermined threshold 124, the separation tire performance analysis module 126 may determine that the first and second separation tires 106 and 112, respectively, operate incorrectly. Further, the separation tire performance analysis module 126 may generate an indication of reduced performance of the printing device 108 until proper installation of the first and second separation tires 106 and 112, respectively.

The apparatus 100 may operate independently of the total drive train torque of the printing device 108. In this regard, since the total drive train torque of the printing device 108 may vary between different types of printing devices, as well as over the life of the printing device 108, the motor torque difference 122 of the motor 104 between the first and second rotary directions 110 and 114, respectively, may provide an independent technique of accurately detecting faulty separation tire installation and/or operation.

According to an example, the separation tire installation and/or operation analysis performed by the apparatus 100 may be performed during idle operation of the printing device 108. For example, the separation tire installation and/or operation analysis performed by the apparatus 100 may be performed during power-on, restart after a physical media jam, and/or at other times during idle operation of the printing device 108.

As will be appreciated, some examples of the apparatus 100 may be configured with more or less modules, where modules may be configured to perform more or less operations. Furthermore, in some examples, the modules may be implemented by execution of instructions with a processing resource to cause the processing resource to perform the corresponding operations.

Referring to FIG. 2, the operation of various other components of the printing device is described.

The printing device 108 may include a drive system connected to a pick tire 200 and pick arm 202. The pick arm 202 may pivot down in the orientation of FIG. 2 to engage the pick tire 200 with a physical media stack. The pick tire 200 may feed the physical media from the physical media stack into the separation tires 106 and 112, and further into the mechanism for printing. The pick arm 202 may include a mechanism to raise the pick arm 202. Sensors to detect the position of the physical media may also be included.

Referring to FIG. 3, the operation of various other components of the printing device is described.

The printing device may include the pick tire 200 and pick arm 202 (see FIG. 2) connected to a drive system to be driven in the forward direction (e.g., left to right in the orientation of FIG. 3) to advance physical media into the separation tires 106 and 112. The pick arm 202 may also include a mechanism to raise the pick arm off a physical media stack to reverse physical media back into a tray or to allow opening of an input tray. Other shafts and rollers may transport physical media further into the print mechanism.

Figure 4:
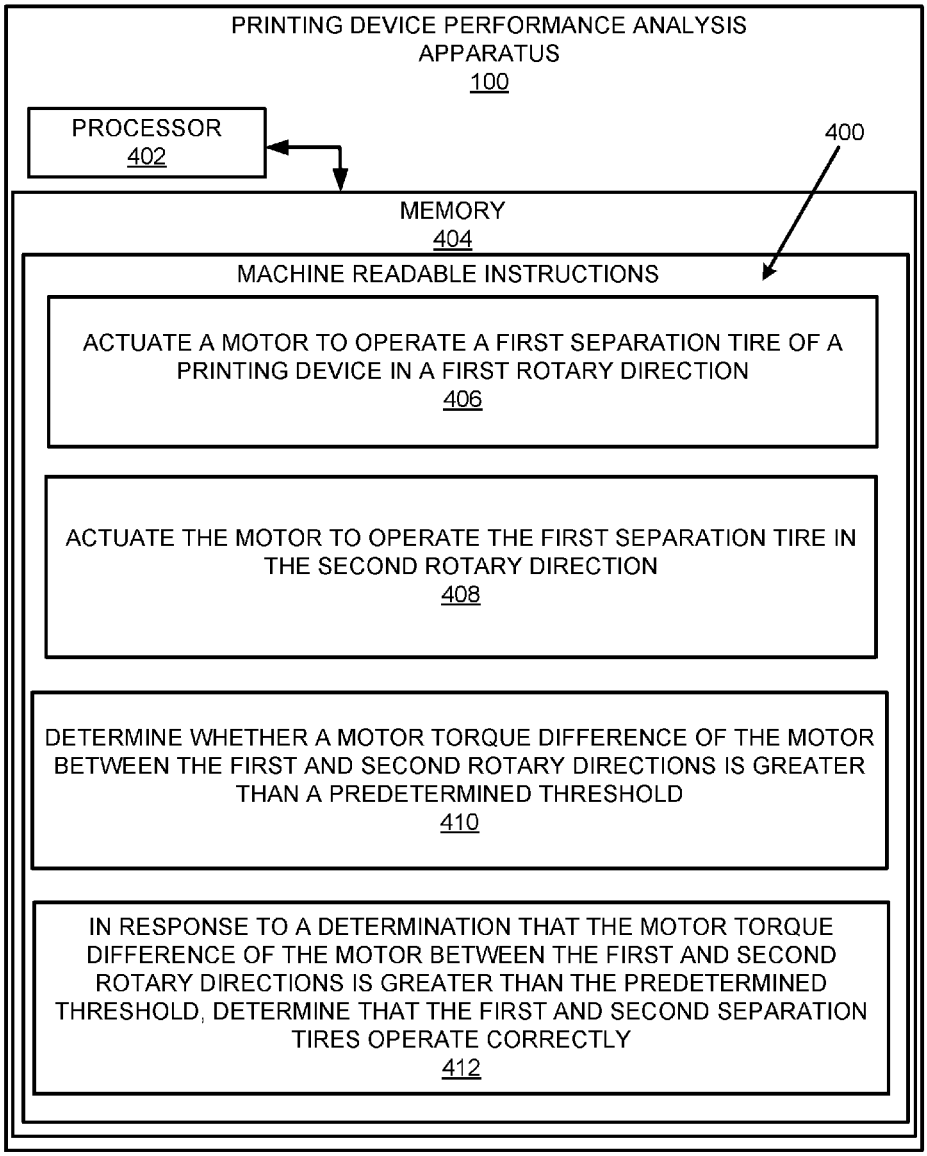
FIG. 4 illustrates a block diagram for printing device performance analysis, according to an example of the present disclosure.
Figure 5:
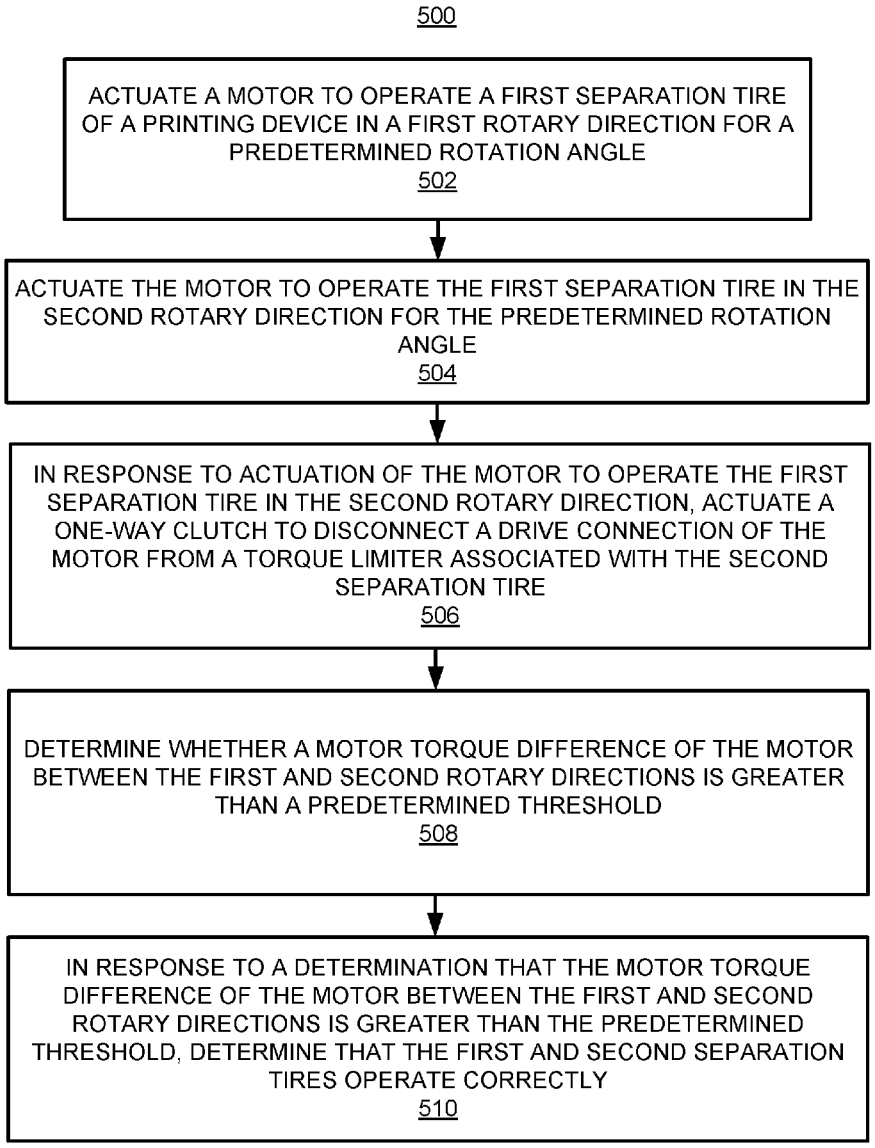
FIG. 5 illustrates a flowchart of a method for printing device performance analysis, according to an example of the present disclosure.
Figure 6:
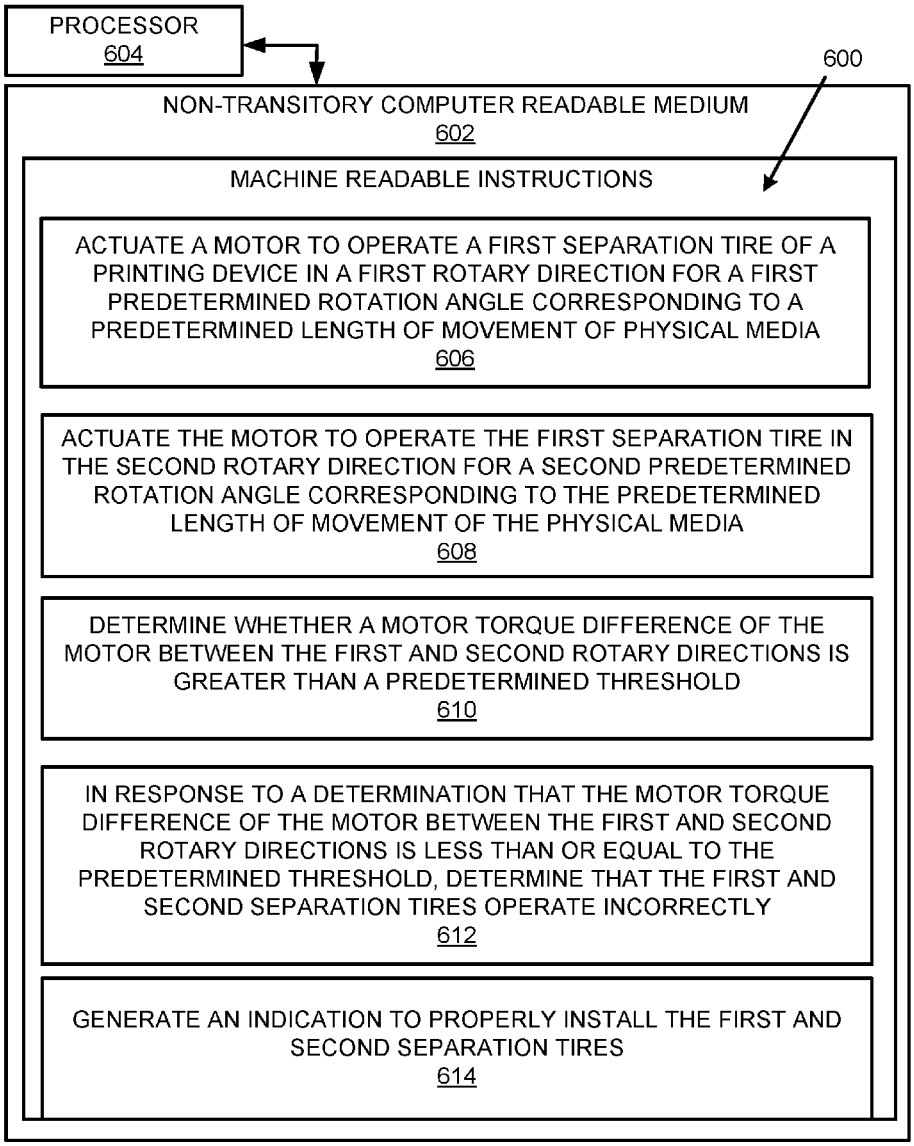
FIG. 6 illustrates a further block diagram for printing device performance analysis, according to an example of the present disclosure.

FIGS. 4-6 respectively illustrate a block diagram 400, a flowchart of a method 500, and a further block diagram 600 for printing device performance analysis, according to examples. The block diagram 400, the method 500, and the block diagram 600 may be implemented on the apparatus 100 described above with reference to FIG. 1 by way of example and not limitation. The block diagram 400, the method 500, and the block diagram 600 may be practiced in other apparatus. In addition to showing the block diagram 400, FIG. 4 shows hardware of the apparatus 100 that may execute the instructions of the block diagram 400. The hardware may include a processor 402, and a memory 404 storing machine readable instructions that when executed by the processor cause the processor to perform the instructions of the block diagram 400. The memory 404 may represent a non-transitory computer readable medium. FIG. 5 may represent a method for printing device performance analysis, and the steps of the method. FIG. 6 may represent a non-transitory computer readable medium 602 having stored thereon machine readable instructions to provide printing device performance analysis. The machine readable instructions, when executed, cause a processor 604 to perform the instructions of the block diagram 600 also shown in FIG. 6.

The processor 402 of FIG. 4 and/or the processor 604 of FIG. 6 may include a single or multiple processors or other hardware processing circuit, to execute the methods, functions and other processes described herein. These methods, functions and other processes may be embodied as machine readable instructions stored on a computer readable medium, which may be non-transitory (e.g., the non-transitory computer readable medium 602 of FIG. 6), such as hardware storage devices (e.g., RAM (random access memory), ROM (read only memory), EPROM (erasable, programmable ROM), EEPROM (electrically erasable, programmable ROM), hard drives, and flash memory). The memory 404 may include a RAM, where the machine readable instructions and data for a processor may reside during runtime.

Referring to FIGS. 1-4, and particularly to the block diagram 400 shown in FIG. 4, at block 406, the memory 404 may include instructions to actuate (e.g., by the motor actuation module 102) a motor 104 to operate a first separation tire 106 of a printing device 108 in a first rotary direction 110. The first separation tire 106 may be operable adjacent to a second separation tire 112 rotatable in a second rotary direction 112 that is opposite to the first rotary direction 110 to separate physical media.

At block 408, the memory 404 may include instructions to actuate (e.g., by the motor actuation module 102) the motor 104 to operate the first separation tire 106 in the second rotary direction 112.

At block 410, the memory 404 may include instructions to determine (e.g., by the motor torque analysis module 120) whether a motor torque difference 122 of the motor 104 between the first and second rotary directions is greater than a predetermined threshold 124.

At block 412, in response to a determination that the motor torque difference 122 of the motor 104 between the first and second rotary directions is greater than the predetermined threshold 124, the memory 404 may include instructions to determine (e.g., by the separation tire performance analysis module 126) that the first and second separation tires 106 and 112, respectively, operate correctly.

Referring to FIGS. 1-3, and 5, and particularly FIG. 5, for the method 500, at block 502, the method may include actuating (e.g., by the motor actuation module 102) a motor 104 to operate a first separation tire 106 of a printing device 108 in a first rotary direction 110 for a predetermined rotation angle. The first separation tire 106 may be operable adjacent to a second separation tire 112 rotatable in a second rotary direction 112 that is opposite to the first rotary direction 110 to separate physical media.

At block 504, the method may include actuating (e.g., by the motor actuation module 102) the motor 104 to operate the first separation tire 106 in the second rotary direction 112 for the predetermined rotation angle.

At block 506, in response to actuation of the motor 104 to operate the first separation tire 106 in the second rotary direction 112, the method may include actuating a one-way clutch 116 to disconnect a drive connection of the motor from a torque limiter 118 associated with the second separation tire 112.

At block 508, the method may include determining (e.g., by the motor torque analysis module 120) whether a motor torque difference 122 of the motor 104 between the first and second rotary directions is greater than a predetermined threshold 124.

At block 510, in response to a determination that the motor torque difference 122 of the motor 104 between the first and second rotary directions is greater than the predetermined threshold 124, the method may include determining (e.g., by the separation tire performance analysis module 126) that the first and second separation tires 106 and 112, respectively, operate correctly.

Referring to FIGS. 1-3, and 6, and particularly FIG. 6, for the block diagram 600, at block 606, the non-transitory computer readable medium 602 may include instructions to actuate (e.g., by the motor actuation module 102) a motor 104 to operate a first separation tire 106 of a printing device 108 in a first rotary direction 110 for a first predetermined rotation angle corresponding to a predetermined length of movement of physical media. The first separation tire 106 may be operable adjacent to a second separation tire 112 rotatable in a second rotary direction 112 that is opposite to the first rotary direction 110 to separate the physical media.

At block 608, the non-transitory computer readable medium 602 may include instructions to actuate (e.g., by the motor actuation module 102) the motor 104 to operate the first separation tire 106 in the second rotary direction 112 for a second predetermined rotation angle corresponding to the predetermined length of movement of the physical media.

At block 610, the non-transitory computer readable medium 602 may include instructions to determine (e.g., by the motor torque analysis module 120) whether a motor torque difference 122 of the motor 104 between the first and second rotary directions is greater than a predetermined threshold 124.

At block 612, in response to a determination that the motor torque difference 122 of the motor 104 between the first and second rotary directions is less than or equal to the predetermined threshold 124, the non-transitory computer readable medium 602 may include instructions to determine (e.g., by the separation tire performance analysis module 126) that the first and second separation tires 106 and 112, respectively, operate incorrectly.

At block 614, the non-transitory computer readable medium 602 may include instructions to generate (e.g., by the separation tire performance analysis module 126) an indication to properly install the first and second separation tires 106 and 112, respectively.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. A printing device performance analysis apparatus comprising:

a processor; and a memory storing machine readable instructions that when executed by the processor cause the processor to:

actuate a motor to operate a first separation tire of a printing device in a first rotary direction, wherein the first separation tire is operable adjacent to a second separation tire rotatable in a second rotary direction that is opposite to the first rotary direction to separate physical media;

actuate the motor to operate the first separation tire in the second rotary direction;

determine whether a motor torque difference of the motor between the first and second rotary directions is greater than a predetermined threshold; and in response to a determination that the motor torque difference of the motor between the first and second rotary directions is greater than the predetermined threshold, determine that the first and second separation tires operate correctly.

2. The apparatus according to claim 1, wherein the first rotary direction represents a forward direction for forwarding the physical media from a supply tray to an output tray.

3. The apparatus according to claim 1, wherein the machine readable instructions, when executed by the processor, further cause the processor to:

determine whether the motor is actuated to operate the first separation tire in the second rotary direction; and in response to a determination that the motor is actuated to operate the first separation tire in the second rotary direction, actuate a one-way clutch to disconnect a drive connection of the motor from a torque limiter associated with the second separation tire.

4. The apparatus according to claim 1, further comprising:

a torque limiter associated with the second separation tire to provide a generally constant torque to the second separation tire when the motor is actuated to operate the first separation tire in the first rotary direction.

5. The apparatus according to claim 1, wherein the machine readable instructions to determine whether the motor torque difference of the motor between the first and second rotary directions is greater than the predetermined threshold further comprise machine readable instructions to cause the processor to:

determine whether the motor torque difference of the motor between the first and second rotary directions is greater than the predetermined threshold based on measurement of motor torque during operation of the motor at a generally constant speed.

6. The apparatus according to claim 1, wherein the machine readable instructions, when executed by the processor, further cause the processor to:

in response to a determination that the motor torque difference of the motor between the first and second rotary directions is less than or equal to the predetermined threshold, determine that the first and second separation tires operate incorrectly; and generate an indication to properly install the first and second separation tires.

7. The apparatus according to claim 1, wherein the machine readable instructions, when executed by the processor, further cause the processor to:

in response to a determination that the motor torque difference of the motor between the first and second rotary directions is less than or equal to the predetermined threshold, determine that the first and second separation tires operate incorrectly;

stop further operation of the printing device in association with the operation of the first and second separation tires; and generate an indication to properly install the first and second separation tires.

8. The apparatus according to claim 1, wherein the machine readable instructions, when executed by the processor, further cause the processor to:

in response to a determination that the motor torque difference of the motor between the first and second rotary directions is less than or equal to the predetermined threshold, determine that the first and second separation tires operate incorrectly; and generate an indication of reduced performance of the printing device until proper installation of the first and second separation tires.

9. A method for printing device performance analysis comprising:

actuating, by a processor, a motor to operate a first separation tire of a printing device in a first rotary direction for a predetermined rotation angle, wherein the first separation tire is operable adjacent to a second separation tire rotatable in a second rotary direction that is opposite to the first rotary direction to separate physical media;

actuating the motor to operate the first separation tire in the second rotary direction for the predetermined rotation angle;

in response to actuation of the motor to operate the first separation tire in the second rotary direction, actuating a one-way clutch to disconnect a drive connection of the motor from a torque limiter associated with the second separation tire;

determining whether a motor torque difference of the motor between the first and second rotary directions is greater than a predetermined threshold; and in response to a determination that the motor torque difference of the motor between the first and second rotary directions is greater than the predetermined threshold, determining that the first and second separation tires operate correctly.

10. The method according to claim 9, wherein determining whether the motor torque difference of the motor between the first and second rotary directions is greater than the predetermined threshold further comprises:

determining whether the motor torque difference of the motor between the first and second rotary directions is greater than the predetermined threshold based on measurement of motor torque during motor operation at a generally constant speed.

11. The method according to claim 9, further comprising:

in response to a determination that the motor torque difference of the motor between the first and second rotary directions is less than or equal to the predetermined threshold, determining that the first and second separation tires operate incorrectly; and generating an indication to properly install the first and second separation tires.

12. A non-transitory computer readable medium having stored thereon machine readable instructions to provide printing device performance analysis, the machine readable instructions, when executed, cause a processor to:

actuate a motor to operate a first separation tire of a printing device in a first rotary direction for a first predetermined rotation angle corresponding to a predetermined length of movement of physical media, wherein the first separation tire is operable adjacent to a second separation tire rotatable in a second rotary direction that is opposite to the first rotary direction to separate the physical media;

actuate the motor to operate the first separation tire in the second rotary direction for a second predetermined rotation angle corresponding to the predetermined length of movement of the physical media;

determine whether a motor torque difference of the motor between the first and second rotary directions is greater than a predetermined threshold;

in response to a determination that the motor torque difference of the motor between the first and second rotary directions is less than or equal to the predetermined threshold, determine that the first and second separation tires operate incorrectly; and generate an indication to properly install the first and second separation tires.

13. The non-transitory computer readable medium according to claim 12, further comprising machine readable instructions, when executed, further cause the processor to:

in response to a determination that the motor torque difference of the motor between the first and second rotary directions is greater than the predetermined threshold, determine that the first and second separation tires operate correctly.

14. The non-transitory computer readable medium according to claim 12, further comprising machine readable instructions, when executed, further cause the processor to:

determine whether the motor is actuated to operate the first separation tire in the second rotary direction; and in response to a determination that the motor is actuated to operate the first separation tire in the second rotary direction, actuate a one-way clutch to disconnect a drive connection of the motor from a torque limiter associated with the second separation tire.

15. The non-transitory computer readable medium according to claim 12, wherein the machine readable instructions to determine whether the motor torque difference of the motor between the first and second rotary directions is greater than the predetermined threshold, when executed, further cause the processor to:

determine whether the motor torque difference of the motor between the first and second rotary directions is greater than the predetermined threshold based on measurement of motor torque during operation of the motor at a generally constant speed.

* * * * *